US005284341A

United States Patent [19]

Routzong et al.

[11] Patent Number: 5,284,341

[45] Date of Patent: Feb. 8, 1994

[54] FOOTBALL

[75] Inventors: James E. Routzong, Essex, Mass.; Keith D. Patterson, Providence, R.I.

[73] Assignee: Little Kids, Inc., East Providence

[21] Appl. No.: 9,542

[22] Filed: Jan. 26, 1993

[51] Int. Cl.[5] ..... A63B 43/02

[52] U.S. Cl. ..... 273/65 EF; 273/DIG. 20; 273/55 B; 273/65 EE; 446/120

[58] Field of Search ..... 273/65 EF, 65 EE, 65 EC, 273/65 ED, 65 E, DIG. 20, 55 B, DIG. 8, 58 K; 446/120

[56] References Cited

U.S. PATENT DOCUMENTS 3,185,476 5/1965 Fechner ..... 273/DIG. 20
3,225,488 12/1965 Goldfarb ..... 273/65 EF X
3,256,020 6/1966 Smith ..... 273/65 EF
5,133,550 7/1992 Handy ..... 273/65 EF X
5,224,704 7/1993 Snell ..... 273/DIG. 20

*Primary Examiner*—George J. Marlo
*Attorney, Agent, or Firm*—Salter, Michaelson & Benson

[57] ABSTRACT

A football is provided with rearwardly extending fins which promote a tight spiralling rotation of the football when it is thrown through the air. A first of the fins is joined to the football by a centrally located notch therein which interlocks with a second fin integral with the football body when the first fin is passed through a centrally located slot in the second fin and adjacent football body. The fins include flat end surfaces which may be received on a supporting surface for supporting the ball in an upright position. The rearwardly extending fins elevate the body portion above the supporting surface and thereby make it easier to kick.

6 Claims, 2 Drawing Sheets

FOOTBALL

BACKGROUND OF THE INVENTION

The instant invention relates to the toy art and more particularly to a toy football.

Toy footballs including fin elements on the body portion thereof have heretofore been known in the art. For example, finned footballs of the general type contemplated by the instant invention are disclosed in the U.S. Pat. Nos. to Goldfarb 3,225,488, and Smith 3,256,020 which represent the closest prior art to the subject invention of which the applicant is aware. Both the Goldfarb and Smith patents disclose inflatable footballs having fins on the body portion of the football at one end thereof. However, the footballs as illustrated in these prior issued patents do not teach the concept of providing a foam football having fins of foam material attached thereto that enables the football to be produced inexpensively but with considerable play value.

SUMMARY OF THE INVENTION

The instant invention provides a toy football with fins that extend rearwardly from one end of the football.

Briefly, the toy football comprises a foam body portion having first and second ends and first and second foam fin elements extending rearwardly from the first end thereof. The first fin element is integrally formed with the body portion at the first end thereof and a slot is cut into the body portion at the first end thereof. The second fin element is die cut from a sheet of foam material and it is formed with a notch therein. The second fin element is extended through the slot in the body portion so that the notch interfittingly engages with the first fin element. The fin elements are operative for promoting a spiral rotation of the football when it is thrown through the air. The fins are further operative as a kicking stand wherein the fin elements are received on a supporting surface so that the football is supported in an upright position. Because the fin elements extend rearwardly from the body portion, the body portion is substantially elevated above the supporting surface thereby making it easier to kick the football.

Accordingly, it is an object of the invention to provide a toy football.

It is another object to provide a foam toy football.

It is still another object to provide a toy football with fins.

It is yet another object to provide a finned football with fins that extend rearwardly from one end of the body portion substantially beyond the end thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
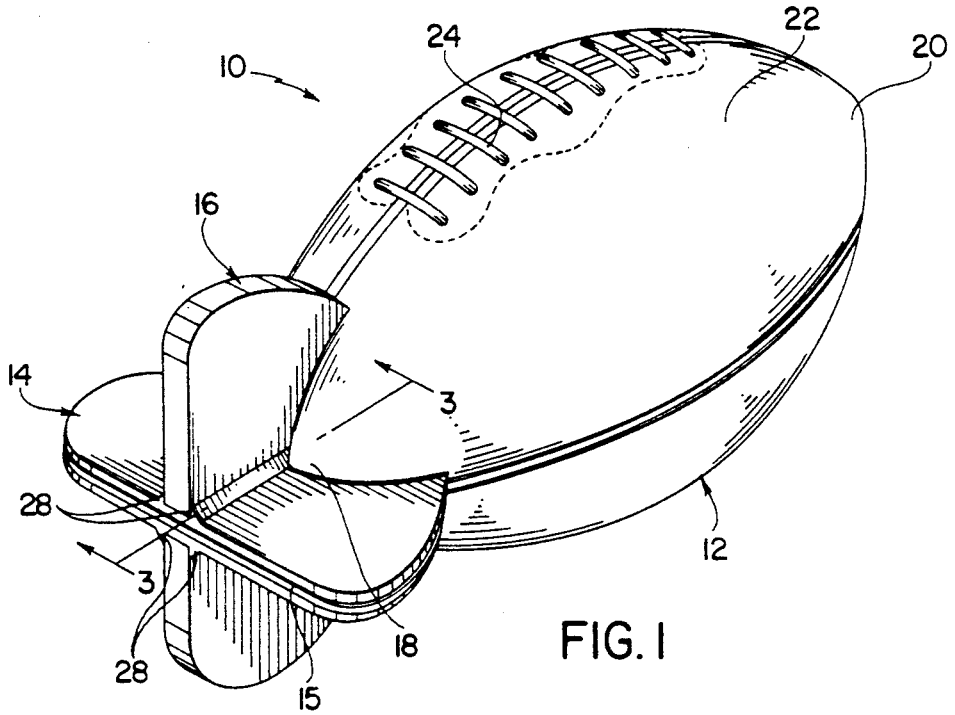
FIG. 1 is a perspective view of the toy football of the instant invention.

Referring now to the drawings, the toy football of the instant invention is illustrated and is generally indicated at 10 in FIGS. 1 through 4. The toy football 10 is preferably formed from a soft foam material and comprises a body portion 12 on which are fixed, a first fin element 14 and a second fin element 16. The body portion 12 is formed with a first end 18 and a second end 20, a longitudinal axis of rotation extending between the first and second ends 18 and 20, and an outer surface 22 covering the body portion. The body portion 12 is preferably approximately 9 inches in length, measured from the first end 18 to the second end 20, and it is formed with a conventional football configuration wherein it increases in diameter from the first end 18 to a midpoint (not shown) and decreases in diameter from the midpoint to the second end 20. The body portion 12 is further formed with a plurality of simulated cross laces 24 which are located on the outer surface 22 between the first and second ends 18 and 20.

Figure 2:
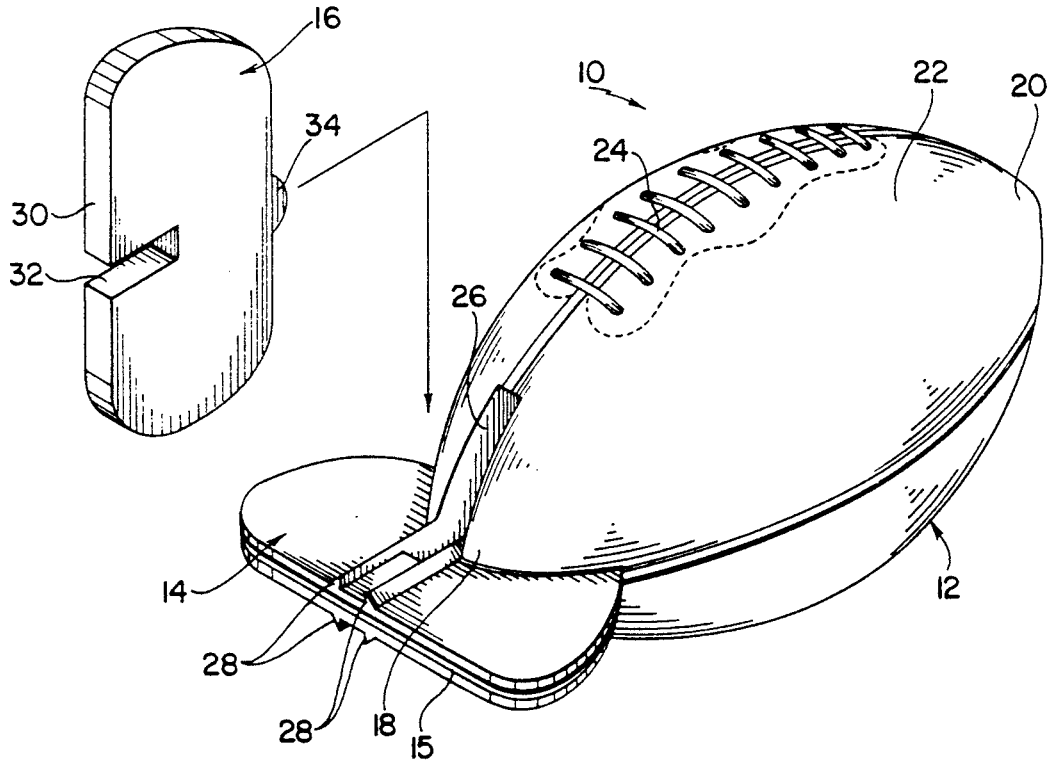
FIG. 2 is an exploded perspective view thereof.

The first fin element 14 is preferably integrally molded with the body portion 12 at the first end 18 and is formed with a flat end surface 15. The first fin element 14 has a width or horizontal dimension generally equal to the diameter of the body portion 12 at the midpoint thereof and extends rearwardly from the body portion 12 approximately 1 inch beyond the first end 18 thereof. In addition, the first fin element 14 is integrally molded to the body portion 12 and is disposed perpendicular to the longitudinal axis of rotation thereof A slot 26 is formed in the body portion 12 adjacent to the first end 18 thereof. The slot 26 extends through the body portion 12 and the first fin element 14 and is perpendicular to the axis of rotation of the body portion 12 and is also perpendicular to the first fin element 14. (See FIG. 2). As also illustrated in FIG. 2 the first fin element 14 further includes rib members 28, on both the upper and lower surfaces thereof, the purpose of which will be described hereinafter.

Figure 3:
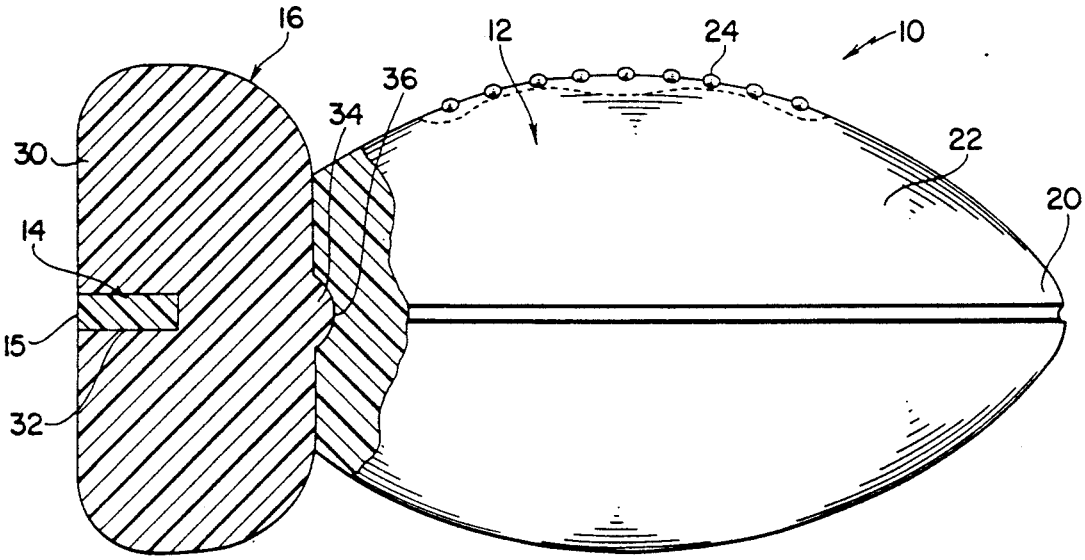
FIG. 3 is a side elevational view of the toy football with fin elements shown in cross-section as taken along line 3—3 in FIG. 1.
Figure 4:
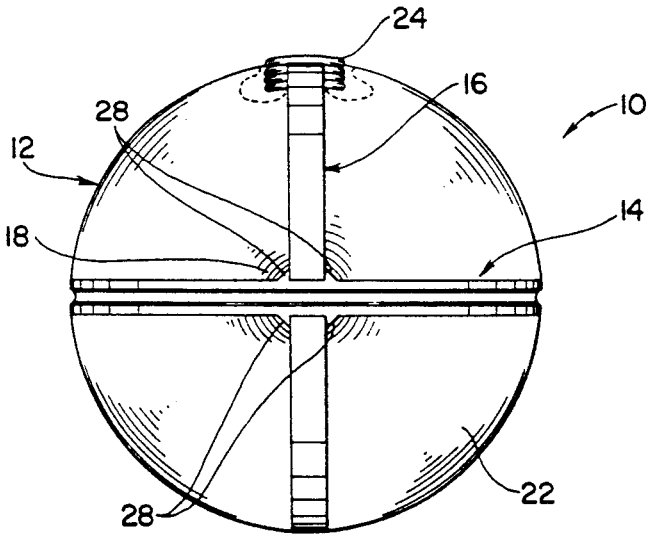
FIG. 4 is an end elevational view thereof.

The second fin element 16 is preferably die cut from a sheet of foam material and includes a flat end surface 30, a notch 32 being formed in the flat end surface 30 and a small nub 34 being located on the fin element 16 opposite to the flat end surface 30. The second fin element 16 is formed with a width generally equal to the diameter of the body portion 12 at the mid-point thereof and extends through the slot 26 so that the nub 34 rests in a corresponding depression 36 formed within the slot 26; and the notch 32 interfittingly receives the first fin element 14 in engagement therewith (See FIG. 3). When assembled with the first fin element 14, the second fin element 16 also extends rearwardly from the body portion 12 approximately 1 inch beyond the first end 18 thereof. The rib members 28 as formed on the upper and lower surfaces of the first fin element 14 engage with the second fin element 16 and prevent sideways movement thereof relative to the first fin element 14. When the fin elements 14 and 16 are assembled as illustrated in FIGS. 1 and 3, the flat end surfaces 15 and 30 thereof lie in a common plane and, in this regard, the flat end surfaces 15 and 30, may be receivable on a generally flat supporting surface for supporting the football 10 in an upright position.

The fin elements 14 and 16 as constructed are operative for promoting a tight spiralling rotation of the football 10 along the longitudinal axis thereof when the ball 10 is thrown through the air. The spiralling rotation created by the fins 14 and 16 enables the ball to be thrown more accurately and for a farther distance than a conventional football that is not formed with fin elements. Even if the football 10 is thrown or kicked through the air in a non-spiralling manner, the fins 14 and 16 cooperate to stabilize the flight of the football 10 and to promote a spiralling movement thereof.

As described hereinabove the rearwardly extending fin elements 14 and 16 further function as a kicking stand for supporting the body portion 12 in an upright position on a supporting surface. Because the fins 14 and 16 extend rearwardly beyond the first end 18 of the football 12, they are effective for substantially elevating the body portion 12 of the football 10 above the supporting surface thereby providing a more accessible kicking surface of the football and enabling the football to be more easily kicked.

It can therefore be seen that the instant invention provides a novel toy football 10 which is easier to throw in a spiral rotation and which includes an integral kicking stand. The fin elements 14 and 16 extend substantially beyond the end 18 of the football 10 which are effective for promoting a tight spiralling effect of the football 10 when it is thrown through the air. The extended fins 14 and 16 are further capable of supporting the body 12 of the football 10 in an upright position, elevated above a supporting surface, thereby making it easier to kick the football 10.

It is contemplated that within the scope of the invention, the physical dimensions of the body portion 12 may be increased or decreased to provide an over-sized football or a mini-football. In this regard, the size of the fins 14 and 16 is also increased or decreased proportionally to the size of the body portion 12 so that the distance which the fins extend rearwardly is approximately equal to 1/9 of the length of the body portion 12.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A football comprising:

a body portion having first and second ends and a longitudinal axis of rotation extending between said first and second ends, said body portion increasing in diameter from said first end to a mid-point on said body portion and decreasing in diameter from said mid-point to said second end;

a first fin element attached to the first end of said body portion perpendicular to said axis of rotation, said first fin element having a width substantially equal to the diameter of said body portion at said midpoint, said first fin element extending rearwardly from the said body portion so as to extend substantially beyond said first end;

a slot in said body portion and said first fin element, said slot being perpendicular to the axis of rotation of said body portion and further being perpendicular to said first fin element;

a second fin element having a width substantially equal to the diameter of said body portion at said midpoint and further having a notch therein, said second fin element being received in said slot, said second fin element extending rearwardly from said body portion so as so extend substantially beyond the first end thereof, said first and second fin elements promoting a tight spiralling effect of said body portion around said longitudinal axis when said football is thrown through the air, said first and second fins being receivable on a supporting surface so as to support said body portion in a an upright position for kicking, said rearwardly extending fins substantially elevating said body portion above said supporting surface 2. In the football of claim 1, said body portion and said first and second fin elements being formed of a foam material.

3. In the football of claim 1, said first fin element having upper and lower surfaces, said first fin element including rib members which extend outwardly from said upper and lower surfaces, said rib members engaging said second fin element to prevent sideways movement of said second fin element relative to said first fin element.

4. In the football of claim 1, said slot having an arcuate depression therein, said second fin element having a nub thereon, said nub being received in said depression when the second fin element is assembled with said body portion.

5. In the football of claim 1, said first and second fin elements having flat ends which are receivable on said supporting surface.

6. In the football of claim 1, said first and second ends being spaced by a first distance, and said first end and said flat ends of said fins being spaced by a second distance, said second distance being approximately equal to 1/9 of said first distance.

* * * * *